US005846093A

United States Patent [19]

Muench, Jr. et al.

[11] Patent Number: 5,846,093

[45] Date of Patent: Dec. 8, 1998

[54] SEPARABLE CONNECTOR WITH A REINFORCING MEMBER

[75] Inventors: Frank John Muench, Jr., Waukesha; John Mitchell Makal, Menomonee Falls, both of Wis.

[73] Assignee: Cooper Industries, Inc., Houston, Tex.

[21] Appl. No.: 861,366

[22] Filed: May 21, 1997

[51] Int. Cl.[6] ..... H01R 13/53

[52] U.S. Cl. ..... 439/89; 439/921

[58] Field of Search ..... 439/181, 183, 439/186, 921, 88

[56] References Cited

U.S. PATENT DOCUMENTS

| | | | |
|---|---|---|---|
| 1,877,586 | 9/1932 | Rah | 174/11 BH |
| 2,379,942 | 7/1945 | Webber | 439/89 |
| 3,376,541 | 4/1968 | Link | 439/181 |
| 3,509,516 | 4/1970 | Phillips | 439/184 |
| 3,509,518 | 4/1970 | Phillips | 439/281 |
| 3,534,323 | 10/1970 | Becker et al. | 439/523 |
| 3,555,487 | 1/1971 | Jones | 439/282 |
| 3,617,987 | 11/1971 | Sankey | 439/184 |
| 3,711,818 | 1/1973 | Swehla | 439/181 |
| 3,725,846 | 4/1973 | Strain | 439/89 |
| 3,860,322 | 1/1975 | Sankey et al. | 439/184 |
| 3,960,433 | 6/1976 | Boliver | 439/186 |
| 4,175,815 | 11/1979 | Andersen et al. | 439/89 |
| 4,758,171 | 7/1988 | Hey | 439/181 |
| 4,904,932 | 2/1990 | Schweitzer, Jr. | 439/133 |
| 5,221,220 | 6/1993 | Rosciewski | 439/843 |

*Primary Examiner*—Neil Abrams
*Assistant Examiner*—T. C. Patel
*Attorney, Agent, or Firm*—Burns, Doane, Swecker & Mathis LLP

[57] ABSTRACT

A novel male connector for an electrical connector assembly comprises an elastic housing which includes a recess for receiving the end of a female connector. When the male and female connectors are connected, a cavity is formed between the female connector and the recess of the male connector. Along the length of the recess, a rigid member is provided in the male connector which prevents the recess from stretching substantially when the male connector is disconnected from the female connector. Because the recess is prevented from stretching, the air pressure in the cavity between the male connector and the female connector remains relatively high during disconnection. The dielectric strength of the air in the cavity, which is a function of pressure, also remains high, so that the possibility of flashover is substantially eliminated.

33 Claims, 3 Drawing Sheets

SEPARABLE CONNECTOR WITH A REINFORCING MEMBER

BACKGROUND

1. Field of the Invention

The present invention relates to electrical connector assemblies such as those used to connect portions of electrical utilities, and more particularly to loadbreak separable connectors.

2. Description of the Related Art

High-voltage separable connectors interconnect sources of energy, such as transformers, to distribution networks and the like. Frequently, it is necessary to connect and disconnect the electrical connectors. These connectors typically feature a male connector which contains a male contact, and a female connector which contains a female contact. The male connector may be in the form of an elbow connector or a protective cap, and the female connector may be in the form of a bushing. The male contact or "probe" is typically maintained within the elbow connector or protective cap, and the female contact is contained within the bushing.

Disconnecting energized connectors is an operation known as loadbreak. During loadbreak, the male connector (e.g., elbow connector or protective cap) is pulled from the female connector (e.g., bushing) using a hotstick to separate the connectors. This, in effect, creates an open circuit. During loadbreak, a phenomenon known as a flashover may occur, whereby an arc from an energized connector extends rapidly to a nearby ground. Existing connector designs contain a number of arc extinguishing components so that the connectors can have loadbreak operations performed under energized conditions with no flashover to ground occurring. Even with these precautions, however, flashovers have occurred on rare occasions.

Flashovers commonly occur before the metal contacts that carry the load current actually separate. The flashover occurs because the connectors are partially separated which provides a path from energized portions of the connectors to a nearby ground. This breakdown usually results in a small flash which causes little or no damage, but which causes much contamination of the interface between the male connector and female connector. On rare occasions, the flash is accompanied by a power follow current that can cause a large external arc. A large external arc may damage the equipment or possibly create a power outage.

Flashovers result from, among other things, a reduction in the dielectric strength of the air which surrounds and insulates energized portions of the connectors. The reduction in dielectric strength arises because the dielectric strength of air is a function of pressure. During the time in which the connectors are disconnected, a partial vacuum is created by the expansion of the volume of the enclosed space between the male connector and the female connector. The increased volume during initial separation results in a lower air pressure and dielectric strength of the air surrounding the energized portions of the connectors.

The reduction in dielectric strength may be especially pronounced in cold weather, for example, or where lubricating grease between the connectors has evaporated or has been forced out of the interface between the male connector and the female connector. Without sufficient lubrication, for example, the elbow connector or protective cap grabs the bushing tightly, causing the elbow or cap to stretch to a significant extent before separating. This further expands the cavity between the elbow or cap and bushing, resulting in a significant reduction in pressure and dielectric strength, which increases the likelihood of a flashover.

A reduction in pressure during disconnection also increases the force required to separate the male connector from the female connector, as the suction tends to hold the parts together. In the same manner, the surrounding air must be compressed during insertion of the male connector onto the female connector which increases the force necessary to connect the two parts.

SUMMARY

The present invention provides an electrical connector with increased dielectric strength to protect against the possibility of flashover. According to exemplary embodiments of the invention, a male connector, such as a protective cap or elbow connector, is provided which is designed to maintain the dielectric strength of the air surrounding energized portions of the male connector when the male connector is disconnected from the female connector.

According to a preferred embodiment, this may be accomplished by providing a rigid member in the male connector along a recess in the male connector. The recess is formed in an elastic material, and is designed to receive the end of the female connector. When the parts are connected, the female connector is received into the recess of the male connector, and a cavity is formed between the male connector and the female connector. When the male connector is removed from the female connector, the rigid member, which lies along the recess in the male connector, prevents the elastic male connector from stretching substantially, and thus prevents the cavity from expanding in volume substantially. Because the cavity is prevented from expanding in volume, the pressure in the cavity does not decrease substantially so that the dielectric strength of the air in the cavity which surrounds energized portions of the connectors remains relatively high. The possibility of flashover is therefore substantially eliminated.

According to one embodiment of the invention, the rigid member may be in the form of a plurality of metal strips embedded in the semiconductive insert in the male connector, or which are fixed to a surface of the semiconductive insert. The rigid member strips preferably extend from behind the recess of the male connector to beyond the locking ring of the male connector.

According to another embodiment, the rigid member may be fixed to or embedded in the exterior semiconductive shield of the male connector. For example, the rigid member may be embedded in the semiconductive shield, or may be bonded to an inner or outer surface of the semiconductive shield. In this embodiment, the rigid member preferably extends from the pulling eye of the male connector to beyond the locking ring.

The male connector can also be constructed to have a first rigid member fixed to the semiconductive insert, and a second rigid member fixed to the semiconductive shield. By providing a rigid member which substantially prevents the male member from stretching during disconnection, the reduction in pressure between the male and female connectors as the connectors are disconnected is reduced. A smaller reduction in pressure results in a greater maintenance of the dielectric strength of the air surrounding energized portions of the connectors which substantially eliminates the possibility of a flashover.

The smaller change in pressure during connection or disconnection also facilitates connection and disconnection because the suction is reduced during disconnection which reduces the force required to separate the male connector from the female connector, and the air compression is reduced during connection, which reduces the force required to push the male connector onto the female connector.

An electrical connector according to a preferred embodiment of the invention comprises a first member which includes a housing having therein a recess for receiving a second member, the recess including a first retaining surface which engages a second retaining surface of the second member to retain the second member in the first member. When the second member is retained in the first member, an interior space is defined between the first member and the second member. The electrical connector also comprises a first electrical contact for making electrical contact with a second electrical contact of the second member when the second member is retained in the first member, and a rigid member fixed to the housing which substantially prevents the housing from stretching when the second member is removed from the first member.

BRIEF DESCRIPTION OF THE DRAWINGS

The foregoing and other objects, features and advantages of the present invention will be more readily understood upon reading the following detailed description in conjunction with the drawings in which.

DETAILED DESCRIPTION OF THE PREFERRED EMBODIMENTS

The construction and operation of conventional electrical connector assemblies are well known and have been in use for many years. Reference is made, for example, to commonly-owned U.S. Pat. No. 5,221,220, issued Jun. 22, 1993 to Rosciewski, which is hereby incorporated herein by reference.

Also incorporated herein by reference is the subject matter of a copending U.S. patent application Ser. No. 08/811,180 entitled Loadbreak Separable Connector filed on Mar. 4, 1997 by the same inventors.

Figure 3:
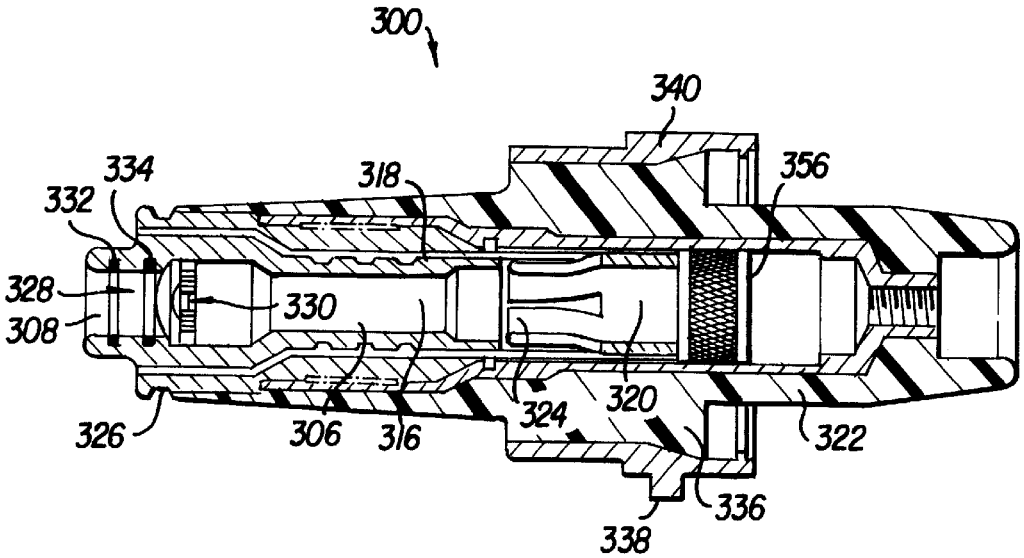
FIG. 3 illustrates a female connector usable with a preferred embodiment of the present invention.

The electrical connector assembly according to an exemplary embodiment of the present invention includes a male connector, such as an elbow connector 100 (FIG. 1) electrically connected to a portion of a high-voltage circuit (not shown), and a female connector 300 (FIG. 3), as for example a bushing insert or connector, connected to another portion of the high-voltage circuit. The male connector may also comprise a protective cap as shown in FIG. 3 of U.S. patent application Ser. No. 08/811,180 filed on Mar. 4, 1997. The male and female connectors are reversibly connectable and respectively interfit to achieve electrical connection.

The elbow connector 100 comprises a housing 115 which houses the electrically conductive elements of the elbow connector 100. The housing 115 according to an exemplary embodiment of the invention, includes an elastomeric and electrically-insulating member 122 of a material such as ethylene-propylene-dienemonomer (EPDM) rubber which is provided on its outer surface with a semiconductive shield layer 124 that may be grounded by means of a perforated grounding tab 126, and which may comprise semiconducting EPDM. The housing 115 may also include a semiconductive insert 140 which is disposed within the insulating member 122.

The elbow connector 100 comprises an upper portion 128 and a lower portion 130 connected at a central portion 132. A pulling eye 134 extends from the central portion 132. An optional test point 136 may be located along the lower portion 130. A generally conical opening 138 is disposed within the housing 115.

The insert 140 may be a semiconductive rubber stress relief insert which is contained within the insulating member 122 such that a lower portion 142 of the insert 140 extends into the lower portion 130 of the elbow connector 100 and an upper portion 144 of the insert 140 extends into the upper portion 128 of the elbow connector 100. The insert 140 has a recess 148 which receives an end of a female connector 300 (FIG. 3). The insert 140 includes a locking ring 150 which mates with a corresponding locking groove 326 on the female connector 300. The insert 140 may be formed of a flexible, elastic, or rubber-like material such as a semiconductive EPDM.

A probe assembly 154 is disposed within the housing 115 and aligned with the axis of the conical opening 138. The probe assembly 154 features a male contact element or probe 158 formed of an electrically conductive material such as copper. The probe assembly 154 threadedly engages a cable connector 156. The cable connector 156 is electrically connected to a cable 155 and is disposed within the lower portion 130 the elbow connector 100. The probe assembly 154 extends from the cable connector 156 into the opening 138.

The probe assembly 154, as well as other exposed conductive parts or ground planes such as the insert 140, may be partially covered with an insulating sheath to prevent flashover, as described in the commonly owned copending U.S. Pat. No. 5,655,921, which is hereby incorporated herein by reference In addition, the recess 148 of the insert 140 may have an enlarged volume, as described in the commonly-owned copending U.S. application Ser. No. 08/811,180 to lessen the reduction in air pressure during disconnection to prevent flashover.

An arc follower 160 of ablative material may be provided at the end of the probe 158. A preferred ablative material for the arc follower 160 is acetal co-polymer resin loaded with finely divided melamine. The ablative material is typically injection molded onto a reinforcing pin (not shown). An annular junction recess 162 is located at the junction between the probe 158 and the arc follower 160.

When energized, the female connector 300 may be covered by a portion of the elbow connector 100. The elbow connector 100 connects the female connector 300 to another portion of a high voltage circuit.

FIG. 3 illustrates an exemplary female connector 300, which is featured as a bushing insert composed generally of an outer electrically insulative member 322 and an inner metallic, electrically conductive tubular assembly with associated components. The construction and operation of female connectors of this type are well-known in the art. However, the major components will be described herein to the extent necessary to understand the invention.

The female connector 300 may be electrically and mechanically mounted to a bushing well (not shown) disposed on the enclosure of a transformer, for example, or other electrical equipment. The female connector 300 has a central passageway 306 therethrough which presents a forward opening 308 which receives the probe 158 of the male connector. An arc interrupter 318 may be provided around a central chamber 316 of the female connector 300 and preferably comprises an ablative material for de-ionization of gasses.

A female contact member 320 is disposed toward the rear of the central passageway 306 and is maintained in a radially central position by a copper knurled piston 356 through which the female contact member 320 may be electrically and mechanically coupled to a bushing well (not shown). For purposes of description, the term "rear" shall mean the end of the bushing well adjacent the electrical equipment and the term "forward" shall mean the direction toward the forward opening 308. The female contact member 320 has a forwardly extending portion 324 which is designed to grip the probe 158 of the male connector. A locking groove 326 is provided on the nose of the female connector 300 which serves as a securing detent for a complementary locking ring 150 of the insert 140 of the elbow connector 100.

The forward end of the central passageway 306 includes an entrance vestibule 328 immediately rearward of the opening 308. The vestibule 328 is separated from the central chamber 316 by a spring-loaded gas trap 330 which is operable between an open position, wherein gas communication is possible between the chamber 316 and the vestibule 328, and a closed position, wherein gas communication is substantially prevented between the chamber 316 and the vestibule 328. The gas trap 330 is spring-biased toward the closed position and may be moved to its open position as the probe 158 of the elbow connector 100 is moved into the central passageway 306 through the vestibule 328 and into the central chamber 316. A pair of elastomeric O-rings 332, 334 are located within the vestibule 328. The O-rings and the gas trap limit the amount of arc-extinguishing gases which are expelled during a switching operation.

A portion of the outer electrically insulative member 322 forms a radially enlarged section 336 which surrounds the central passageway 306. The enlarged section 336 carries an annular semiconductive shield 340 about its circumference. One or more ground tabs 338 may be molded into the semiconductive shield 340 for attachment of a ground wire. A thin sleeve of insulative material (not shown) may be disposed along the outer radial surface of the semiconductive shield 340 to prevent a flashover from an energized portion of the male connector from reaching the grounded semiconductive shield 340, as described in the above-referenced U.S. Pat. No. 5,655,921. Preferably, the sleeve encloses or encapsulates the entire outer radial surface of the semiconductive shield 340.

During a loadbreak or switching operation, the male connector 100 is separated from the female connector 300. The connectors are energized when they are electrically connected to a high voltage distribution circuit. During a loadbreak operation, separation of electrical contact occurs between the probe 158 and the female contact 320.

In a conventional connector assembly, arcing may unexpectedly and undesirably occur on rare occasions during a loadbreak operation, the arc typically extending from exposed conductive portions of the probe or the insert of the male connector to a nearby ground plane. Arcing or flashover in a conventional connector assembly may be caused by a reduction in the dielectric strength of the air which surrounds energized portions of the connectors during disconnection. The reduction in dielectric strength of the air occurs because the dielectric strength of air is proportional to the pressure of the air. The relationship between pressure and dielectric strength is expressed in Paschen's law.

At atmospheric pressure, air has a given dielectric strength. As the pressure falls to about 0.1 atmospheres, the dielectric strength of air falls linearly. The dielectric strength of air stabilizes at a relatively low level, in the range of 0.1 atmospheres to 0.001 atmospheres, at which level, the dielectric strength begins to increase dramatically at these very low vacuum levels.

When the female connector is removed from the male connector in a conventional system, the insert of the male connector stretches to a certain extent before the locking ring of the insert of the male connector is released from the locking groove on the nose of the female connector. This causes the cavity between the two parts to increase in volume before the locking ring snaps out of the locking groove, resulting in a reduction in pressure and resulting reduction in the dielectric strength of the air surrounding energized portions of the connectors.

Figure 4:
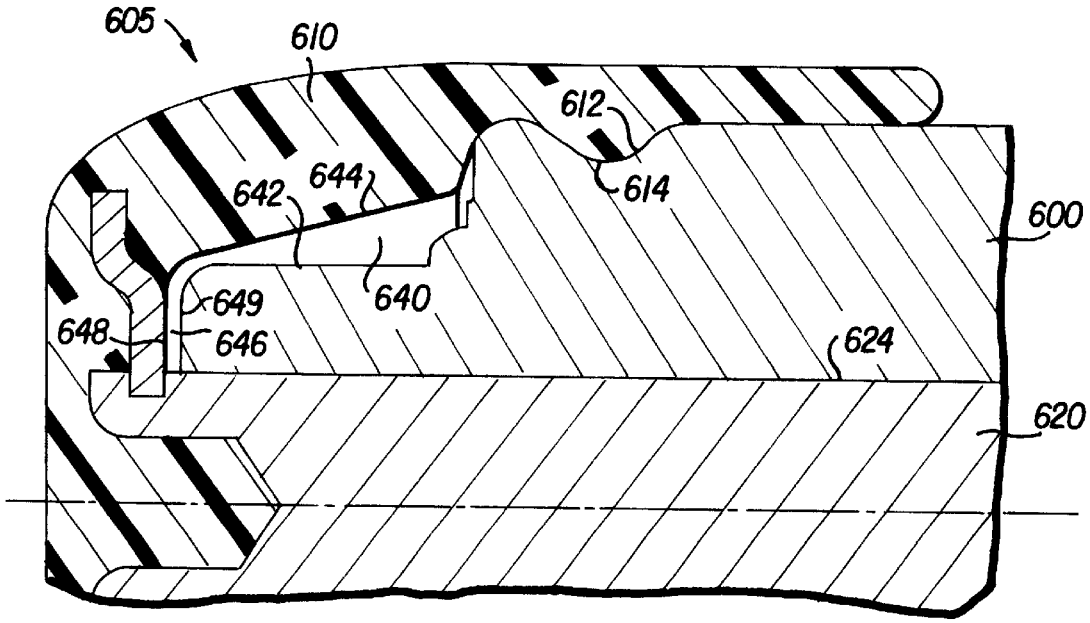
FIG. 4 illustrates portions of a conventional protective cap.

FIG. 4 shows portions of a conventional connector assembly which includes a female connector 600 fully inserted into an insert 610 of a protective cap 605. The female connector 600 includes an annular locking groove 612 which engages with a complementary locking ring 614 of the protective cap 605. The protective cap 605 also includes a probe 620 which is received in a central bore 624 of the female connector 600.

As shown in FIG. 4, when the female connector 600 is fully inserted into the insert 610, of the protective cap 605, a first space 640 remains between the side 642 of the female connector 600 and a conical wall 644 of the insert 610. A second space 646 also remains between the end 649 of the female connector 600 and an inner end wall 648 of the insert 610. The air in the connector assembly results from clearance allowances to ensure there are no physical interferences between parts.

During disconnection of the protective cap 605 from the female connector 600, the insert 610 which is made of an elastomeric material, stretches to a certain extent. The stretching of the protective cap 605 is concentrated in the region of air space 640, 646, since the protective cap 605 is tightly locked to the female connector 600 in the other regions. The extent of stretching may be increased by a number of factors. For example, the female connector 600 may stick to the insert 610 of the protective cap 605 due to cold weather or due to the drying out of a lubricant between the female connector 600 and the protective cap 605.

According to Boyle's law, the product of the pressure and volume of a gas in a closed system is a constant. That is, the initial pressure $P_i$ times the initial volume $V_i$ equals the final pressure $P_f$ times the final volume $V_f$. Thus, $P_f=P_iV_f$. Since $V_i$, the total space 640, 646 between the female connector 600 and the insert 610, is quite small, it requires only a small change in the final volume $V_f$ to reduce the pressure in the first and second spaces 640, 646 substantially.

Under some circumstances, the insert 610 may stretch to such an extent that the first and second spaces 640, 646 between the female connector 600 and the insert 610 increase to about three times the original volume. The pressure in the first and second spaces 640, 646 therefore drops from atmospheric pressure to about 33% of atmospheric pressure during separation, or 4.78 psi, which reduces the dielectric strength of the surrounding air to nearly its minimum value according to Paschen's law. The possibility of the occurrence of arcing from the energized insert 610 or probe 620 to a nearby ground plane is therefore more likely.

Figure 1:
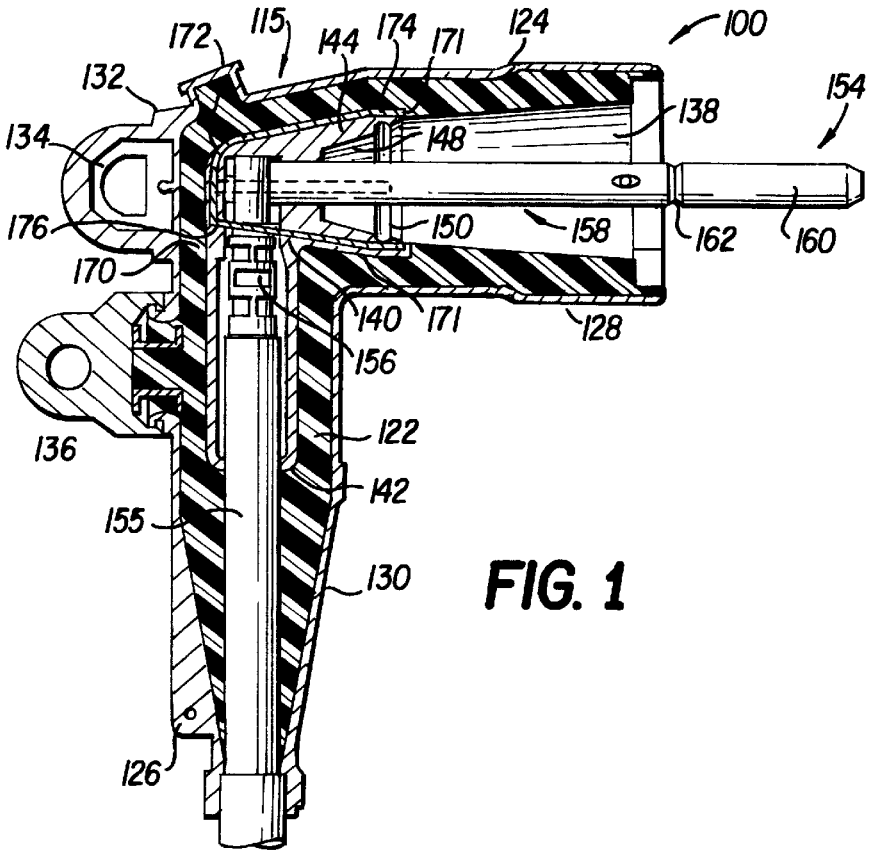
FIG. 1 illustrates an elbow connector according to an exemplary embodiment of the invention.

The novel elbow connector 100 shown in FIG. 1 includes a rigid member 170 which significantly lessens the reduction in air pressure during separation to maintain the dielectric strength of the connector assembly. The rigid member 170 may include a plurality of thin metal strips 171 that are embedded in the insert 140, and which extend from a location behind the cable connector 156 to a location forward of the locking ring 150. The rigid member 170 also includes a rear portion 176 which passes between the cable connector 156 and the pulling eye 134. The rear portion 176 anchors the rigid member 170 in the insert 140 along a longitudinal direction of the upper portion 144 of the insert 140.

The rigid member 170 preferably includes four strips 171, which are arranged at the top, bottom, left and right sides of the insert 140 and which are connected together at their ends behind the cable connector 156. Any number of strips 171 may be used in any locations, provided that the number and locations permit insertion and removal of the connector 300 and substantially prevent stretching of the insert 140 during this insertion and removal.

The rigid member 170 may be stamped or formed from a single sheet of metal, or the individual strips may be formed separately and connected together by any suitable means known to those skilled in the art, such as welding, riveting, or adhesives.

The rigid member 170 is formed of a stretch-resistant material, such as a metal. The rigid member should be flexible to permit expansion of the insert 140 during insertion and removal of the connector 300. However, it should be sufficiently rigid so as to prevent the elbow connector 100, and in particular, the insert 140, from stretching during insertion and removal of the connector 300.

The rigid member 170 may be in the form of a wrap, strap, or other shape fixed in the end of the stress relief insert of the male connector 100.

The reinforcing rigid member 170 preferably spans the upper portion 144 of the internal stress relief insert 140, from behind the cable connection region to a region just past the locking ring 150, including the recess 148 which receives the end of the female connector 300. By spanning the recess 148 where the stretching of the insert 140 is normally concentrated, the rigid member 170 substantially prevents the elbow connector 100 from stretching as force is applied to the pulling eye 134 during disconnection of the male connector from the female connector. By preventing the insert 140 from stretching, the air volume in the cavity between the end of the female connector 300 and the recess 148 of the insert 140 is maintained substantially constant during disconnection, so that the pressure and dielectric strength of the air in the cavity remains substantially constant. The dielectric strength of the connector assembly therefore remains at a high level, substantially reducing the likelihood of breakdown as the elbow connector or protective cap is removed from the female connector to prevent flashover from occurring.

The rigid member 170 may be located inside, on top of, or under the insert 140. The rigid member 170 may be fixed to the semiconductive insert 140 by a variety of methods. For example, the rigid member 170 may be integrally molded with the insert 140 forming a single part. The rigid member 170 may also be glued or bonded to an inner or outer surface of the insert 140 using heat or adhesives.

The rigid member 170 is preferably sufficiently thin and flexible so that its circumference expands somewhat during connection and disconnection. Expansion of the circumference of the rigid member 170 allows the locking ring 150 of the elbow connector 100 to slide over the mating locking groove 326 of the female connector 300 during connection and disconnection.

Although not specifically illustrated in this application, the present invention is equally applicable to a protective cap, such as that illustrated in FIG. 3 of the above-referenced patent application Ser. No. 08/811,180. Accordingly, such a protective cap may include the rigid member 170 of the present invention in the manner disclosed herein.

Figure 2:
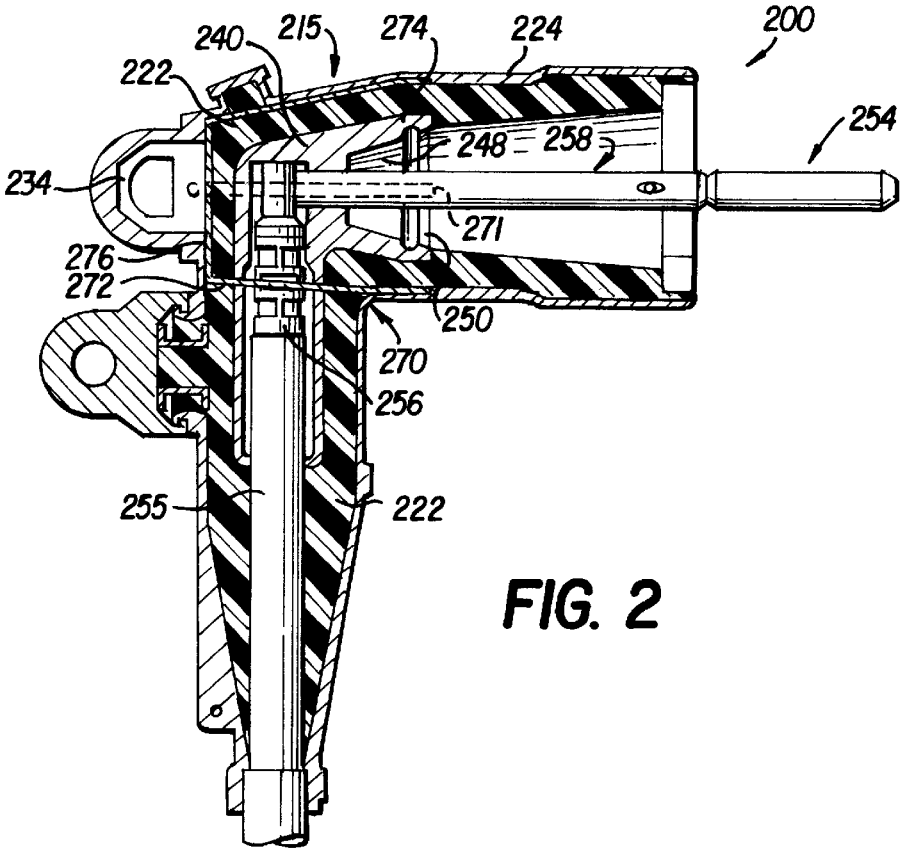
FIG. 2 illustrates an elbow connector according to another embodiment of the invention.

FIG. 2 illustrates a novel elbow connector 200 according to another embodiment of the invention. The elbow connector 200 comprises a housing 215 which includes an electrically insulating member 222, an exterior semiconductive shield 224, and a semiconductive insert 240. The elbow connector 200 also includes a probe 258, a cable connector 256 electrically connected to the probe 258, and a cable 255 electrically connected to the cable connector 256. The probe 258 contacts the female contact 320 of the female connector 300 to establish an electrical connection. A pulling eye 234 is provided to facilitate removal of the elbow connector 200 from the female connector 300.

The insert 240 includes a locking ring 250 which engages with a complementary locking groove 326 on the nose of the female connector 300 to retain the elbow connector 200 in the female connector 300. The insert 240 preferably comprises an elastomeric material such as semiconductive EPDM. These elements function as described with respect to the equivalent elements of FIG. 1.

The elbow connector 200 shown in FIG. 2 includes a rigid member 270 which significantly lessens the reduction in air pressure during separation to maintain the dielectric strength of the connector assembly. The rigid member 270 may include a plurality of strips 271, similar to the strips 171 disclosed in FIG. 1, and which are connected together at their ends behind the cable connector 256.

The rigid member 270 also includes a rear portion 276 which passes between the pulling eye 234 and the insulating member 222. The rear portion is preferably fixed to the pulling eye 234 so that it reinforces the pulling eye 234, increasing its tensile and rotational strength.

Figure 5:
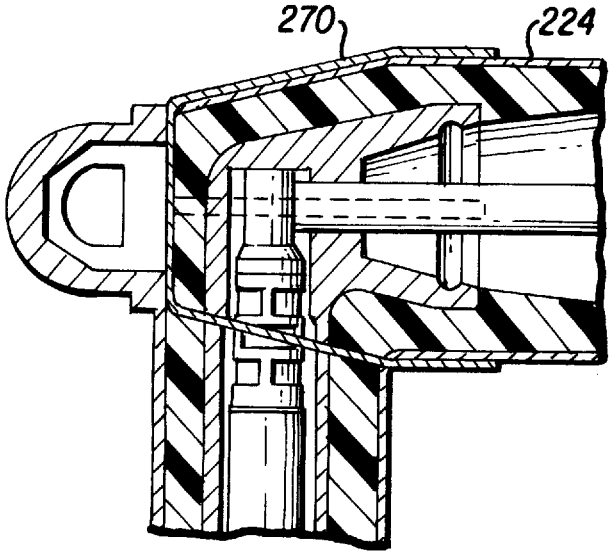
FIG. 5 illustrates a partial cross section of an elbow connector according to another embodiment of the present invention where the rigid member is located on the semiconductive shield of the elbow connector.

The rigid member 270 is formed of a stretch resistant material such as a metal. The rigid member 270 may be located in, on (see FIG. 5), or under the outer grounded semiconductive shield 224 of the elbow connector 200. The rigid member 270 may be fixed to the semiconductive shield 224 by a variety of methods. For example, the rigid member 270 may be integrally molded with the semiconductive shield 224 forming a single part. The rigid member 270 may also be glued or bonded to an inner or outer surface of the semiconductive shield 224 using heat or adhesives. Because the rigid member 270 can be added and secured to the semiconductive shield 224 using adhesives, heat, or other attachment methods, it is possible to retrofit existing elbow connectors with the rigid member 270.

The reinforcing rigid member 270 preferably spans, the semiconductive shield 224 from the back of the insert 240 adjacent to the pulling eye 234 to a region past the locking ring 250 of the insert 240, including the recess 248 which receives the end of the female connector 300. By spanning the recess 248 where the stretching of the insert 240 is normally concentrated, the rigid member 270 substantially prevents the elbow connector 200 from stretching as force is applied to the pulling eye 234 during disconnection of the male connector from the female connector.

By preventing the insert 240 from stretching, the air volume in the cavity between the end of the female connector 300 and the recess 248 of the insert 240 is maintained substantially constant during disconnection, so that the pressure and dielectric strength of the air in the cavity remains substantially constant. The dielectric strength of the connector assembly therefore remains at a high level, substantially eliminating the likelihood of breakdown as the elbow connector or protective cap is removed from the female connector to prevent flashover from occurring.

The rigid member 270 is preferably sufficiently thin and flexible so that its circumference expands somewhat during connection and disconnection of the male and female connectors. Expansion of the circumference of the rigid member 270 allows the locking ring 250 of the elbow connector 200 to slide over the mating locking groove 326 of the female connector 300 during connection and disconnection.

A third embodiment, not illustrated, includes the rigid member 170 of FIG. 1 and the rigid member 270 of FIG. 2, combined in one connector.

Although not specifically illustrated in this application, the present invention is equally applicable to a protective cap, such as that illustrated in FIG. 3 of the above-referenced patent application Ser. No. 08/811,180. Accordingly, such a protective cap may include the rigid member 270 of the present invention in the manner disclosed herein.

Furthermore, as previously stated, either or both of the rigid members 170, 270 disclosed herein may be used in connection with the teachings of the application patent Ser. No. 08/811,180 entitled Loadbreak Separable Connector by Frank J. Muench and John M. Makal. Specifically, the connectors disclosed in the copending application may be reinforced with one or both of the rigid members 170, 270 disclosed herein. Accordingly, the subject matter of the copending application is incorporated herein by reference.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. An electrical connector comprising:

a first member which includes:

a housing having an insulative portion and a first retaining portion having a recess for receiving a second member, the first retaining portion having a first retaining surface for engaging a second retaining surface of the second member to retain the second member in the first member, wherein when the second member is retained in the first member, an interior space is defined between the first retaining portion and the second member;

a first electrical contact for making electrical contact with a second electrical contact of the second member when the second member is retained in the first member; and a rigid member embedded within the insulative portion of the housing, and being more rigid than the first retaining portion to substantially prevent at least one of the housing and the first retaining portion from stretching when the second member is removed from the first member.

2. The electrical connector of claim 1, wherein the rigid member includes a plurality of thin metal strips extending longitudinally within the housing.

3. The electrical connector of claim 1, wherein the housing comprises an insert, and the rigid member is fixed to the insert.

4. The electrical connector of claim 1, wherein the housing comprises an insert, and the rigid member is embedded within the insert.

5.The electrical connector of claim 1, wherein the first member further comprises a pulling eye, wherein the rigid member is fixed to the pulling eye.

6. The electrical connector of claim 1, wherein the housing comprises an insert and a shield; and the rigid member comprises a first portion fixed to the insert and a second portion fixed to the shield.

7. The electrical connector of claim 1, wherein the first retaining surface comprises a locking ring, and the second retaining surface comprises a locking groove.

8. The electrical connector of claim 1, wherein the first member comprises one of an elbow connector and a protective cap.

9. The electrical connector of claim 1, wherein the housing comprises one of rubber, EPDM, or an elastomeric material.

10. The electrical connector of claim 1, wherein the rigid member comprises one of a metal and a rigid plastic.

11. An electrical connector comprising:

a first member which includes an insulating member having therein an opening for receiving a second member;

an elastic insert within the opening of the insulating member, the elastic insert having a first engaging surface for engaging a second engaging surface of the second member; and a rigid member within the first member and fixed to the elastic insert, the rigid member being more rigid than the elastic insert to substantially prevent the elastic insert from stretching when the second member is removed from the first member.

12. The electrical connector of claim 11, wherein the rigid member includes a plurality of thin metal strips extending longitudinally within the housing.

13. The electrical connector of claim 11, wherein the rigid member is embedded within the elastic insert.

14. The electrical connector of claim 11, wherein the first member comprises one of an elbow connector and protective cap.

15. The electrical connector of claim 11, wherein the rigid member is fixed to a surface of the elastic insert.

16. The electrical connector of claim 15, wherein the rigid member is fixed to one of an inner surface and an outer surface of the elastic insert.

17. The electrical connector of claim 15, wherein the rigid member is fixed to a surface of the elastic insert with an adhesive material.

18. The electrical connector of claim 11, wherein the elastic insert has therein a receiving space for receiving the second member, and the rigid member extends along a length of the receiving space in a longitudinal direction.

19. An electrical connector comprising:

a first member which includes an insulating member having an opening therein for receiving a second member;

an insert within the insulating member, the insert having a receiving space for receiving the second member and a first retaining surface for engaging a second retaining surface of the second member to retain the second member in the first member;

a shield disposed on an outer surface of the insulating member; and a rigid member extending along an entire length of the receiving space, fixed to the shield, and being more rigid than the insert to substantially prevent the insert from stretching.

20. The electrical connector of claim 19, wherein the rigid member is embedded within the shield.

21. The electrical connector of claim 19, wherein the rigid member is fixed to a surface of the shield.

22. The electrical connector of claim 1, wherein the first retaining portion is an electrically conductive elastomeric insert.

23. The electrical connector of claim 1, wherein the housing includes an opening into the recess and the first retaining portion includes an inner end wall opposite from the opening into the recess, the rigid member located at least partially between the first retaining surface and the inner end wall of the recess.

24. The electrical connector of claim 1, wherein the rigid member extends along an entire length of the recess along a longitudinal direction of the first electrical contact.

25. The electrical connector of claim 1, wherein the rigid member is more rigid than EPDM.

26. The electrical connector of claim 11, wherein the rigid member is embedded within the insulating member.

27. The electrical connector of claim 11, wherein the rigid member is located between the elastic insert and the insulating member.

28. The electrical connector of claim 19, wherein the insert is elastic.

29. An electrical connector comprising:

a first member having an insulating portion, said insulating portion having an opening for receiving a second member;

a conductive insert within the opening of the insulating member, the insert having a receiving space for receiving the second member; and a rigid member extending along an entire length of the receiving space and being more rigid than the conductive insert, to substantially prevent the conductive insert from stretching when the second member is removed from the first member.

30. The electrical connector of claim 29, wherein the conductive insert is elastic.

31. The electrical connector of claim 29, wherein the first member includes an outer layer of conductive shielding and the rigid member is located within the housing between the receiving space and the outer layer.

32. The electrical connector of claim 29, wherein the first member includes an outer layer of conductive shielding, and the rigid member is fixed to the outer layer.

33. The electrical connector of claim 32, wherein the outer layer is a conductive elastomeric material.

* * * * *